US005807192A

United States Patent [19]

Yamagishi et al.

[11] Patent Number: 5,807,192

[45] Date of Patent: Sep. 15, 1998

[54] SOLID GOLF BALL

[75] Inventors: Hisashi Yamagishi; Junji Hayashi; Atsushi Nakamura; Yasushi Ichikawa, all of Chichibu, Japan

[73] Assignee: Bridgestone Sports Co., Ltd., Tokyo, Japan

[21] Appl. No.: 728,074

[22] Filed: Oct. 9, 1996

[30] Foreign Application Priority Data

Oct. 16, 1995 [JP] Japan ..... 7-293728

[51] Int. Cl.[6] ..... A63B 37/06; A63B 37/12

[52] U.S. Cl. ..... 473/377; 473/372; 473/378; 273/DIG. 20

[58] Field of Search ..... 473/372, 377, 473/378; 273/DIG. 20

[56] References Cited

U.S. PATENT DOCUMENTS

| | | | |
|---|---|---|---|
| 4,863,167 | 9/1989 | Matsuki et al. | 473/373 |
| 5,480,155 | 1/1996 | Molitor et al. | 473/354 |
| 5,482,285 | 1/1996 | Yabuki et al. | 473/373 |

*Primary Examiner*—George J. Marlo

*Attorney, Agent, or Firm*—Sughrue, Mion, Zinn, Macpeak & Seas, PLLC

[57] ABSTRACT

A solid golf ball comprising a solid core and a cover is adjusted to a weight of 40 grams to less than 45 grams and a moment of inertia of 80–90 g·cm$^2$. By virtue of a light weight and a high of inertia, the golf ball provides improved flight performance upon hitting at a low head speed, less than 40 m/sec, offers straight travel upon putting, and is thus suitable for those golf players with a low head speed. The golf ball has a PGA compression of up to 90.

11 Claims, 1 Drawing Sheet

SOLID GOLF BALL

BACKGROUND OF THE INVENTION

1. Field of the Invention

This invention relates to a solid golf ball best suited for golf players who swing at a low head speed. More particularly, it relates to a solid golf ball having a relatively light weight and a high inertia moment, improved flight performance, reduced shock upon hitting, and straight travel upon putt and approach strokes.

2. Prior Art

For golf balls, various proposals have been made for increasing a flight distance, reducing shock upon hitting, and improving straight rolling on the green. This is also true for solid golf balls.

Most of these advanced golf balls target those golf players who swing at a head speed of higher than 45 m/sec., that is, experienced players. Then those golf players capable of high head speed swing can take advantage of the advanced balls, enjoying an increased flight distance and a pleasant feeling. However, those golf players who swing at a low head speed, including beginner, female and senior players cannot take full advantage of the advanced balls. The reason is that the flight performance is more dependent on a head speed since a weaker force applied to the ball upon impact causes a smaller deformation to the ball.

Usually, players with a slow head speed select softer ones of the advanced balls. Since the softer balls, however, are not originally designed optimum for slow-head-speed players, the balls not only follow a low trajectory rather than a high trajectory upon hitting, failing to extend a flying distance, but also offer unpleasant shock upon hitting. Additionally, these balls do not roll straight on the green because of their low moment of inertia.

SUMMARY OF THE INVENTION

An object of the present invention is to provide a novel and improved solid golf ball which is increased in flying distance upon hitting at a low head speed, gives less shocks or a pleasant feel, offers straight rolling, and is thus suitable for those golf players with a low head speed.

This invention pertains to a solid golf ball having a solid core enclosed with a cover. The inventors have found that this and other objects can be attained by controlling the weight and moment of inertia of the golf ball to optimum values for low head speed hitting. More specifically, the ball should have an appropriately light weight in the range of 40 grams to less than 45 grams. Upon low head speed hitting, such a lightweight golf ball will fly high and follow a high trajectory, eventually covering a longer distance. Shock upon hitting is reduced, offering a pleasant feel. The ball should also have a moment of inertia of at least 80 g·cm$^2$. The ball is then improved in rolling. This ensures stable rolling of the ball upon putting and approach strokes and straight travel on the green without detracting from the above-mentioned advantages of flight distance and hitting feel. The resulting solid golf ball is best suited for those golf players with a low head speed.

BRIEF DESCRIPTION OF THE DRAWING

The sole FIGURE is a sectional view illustrating the solid golf ball of this invention.

DETAILED DESCRIPTION OF THE INVENTION

Figure 1:
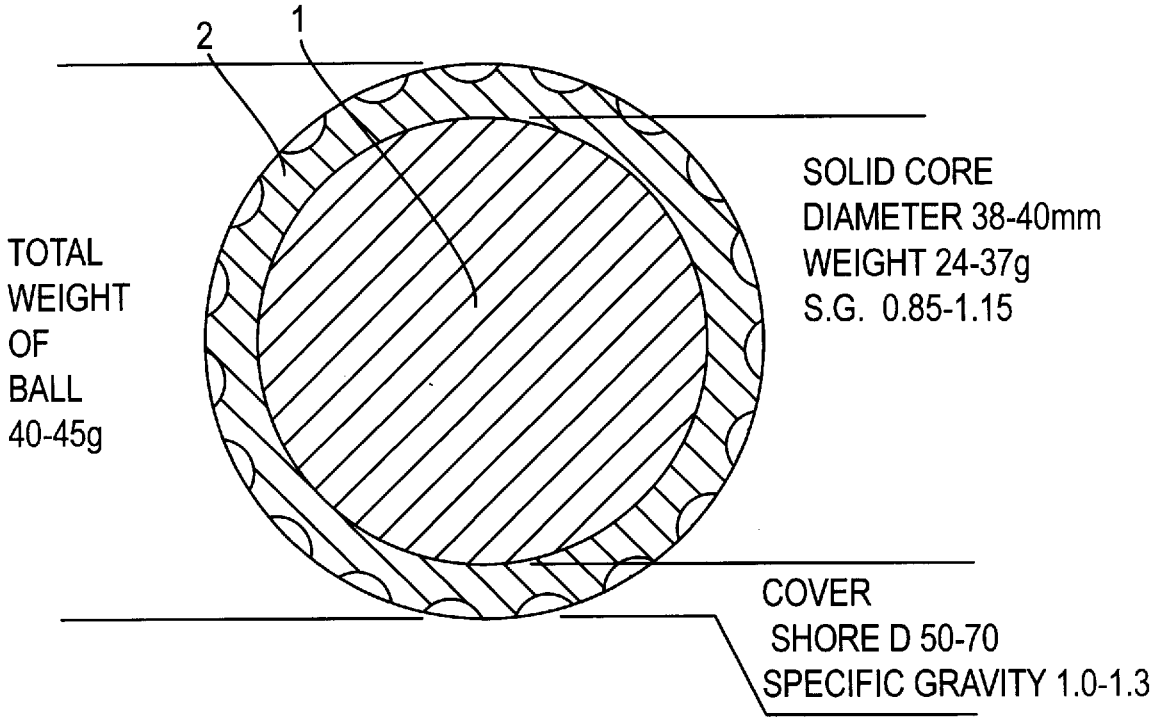

According to the present invention, a solid golf ball having a solid core 1 enclosed with a cover 2 is improved by reducing the ball weight to a light weight appropriate for low head speeds and increasing the moment of inertia. These measures lead to an increased flight distance upon low head speed hitting, less shocks or a pleasant feel upon hitting, and straight travel upon putting and approach strokes. That is, the ball is given appropriate characteristics for those golf players with a low head speed.

According to the invention, the ball has a weight in the range of 40 grams to less than 45 grams, preferably 42 to 44 grams. Balls having a weight of less than 40 grams offer a pleasant hitting feel, but are aerodynamically affected by the wind during flight and fail to cover a long distance because of a too low an inertia force. Balls having a weight of 45 grams or more have no significant difference from conventional solid golf balls, cannot exert their performance upon low head speed hitting, and give strong shock upon hitting.

In addition to the weight requirement, the solid golf ball of the invention should have a moment of inertia of at least 80 g·cm$^2$, preferably 80 to 90 g·cm$^2$. With an inertia moment of less than 80 g·cm$^2$, the rotational stability of the ball would be insufficient and especially, the stability of rolling on the green upon putting and approach shots would be lost, failing to achieve the improvement in rolling stability.

Though not critical, the solid golf ball of the invention should preferably have a PGA compression of up to 90, especially 60 to 88 because shocks upon hitting are further reduced, offering a more pleasant hitting feel. The term "PGA compression" is the magnitude of a load necessary to induce a certain deflection (about 2.5 mm) of a ball. A PGA compression of 90 means that the load is 90 kg. Greater values of compression indicate harder balls.

As mentioned above, the golf ball of the invention is a solid golf ball having a solid core and a cover enclosing the core. It may be a two-piece solid golf ball or a three or multi-piece solid golf ball wherein the core or cover is composed of a plurality of layers. Better results are obtained with two-piece solid golf balls.

Though not critical, the solid core 1 preferably has a weight of 24 to 37 grams, especially 25 to 35 grams and a diameter of 38 to 40 mm, especially 38.1 to 39.7 mm, and a specific gravity of 0.85 to 1.15, especially 1.0 to 1.13.

The cover 2 formed around the core preferably has a hardness of 50 to 70 degrees, especially 55 to 60 degrees on Shore D scale. A cover with a Shore D hardness of less than 50 degrees would have low restitution, failing to travel a long distance. A cover with a Shore D hardness of more than 70 degrees would be less durable and poor in hitting feel. Preferably the cover has a specific gravity of at least 1, especially 1.0 to 1.3. A cover with a specific gravity of less than 1 would lead to a lower inertia moment. Also preferably the cover has a gage (or radial thickness) of 1.4 to 2.4 mm, especially 1.6 to 2.2 mm.

In the solid golf ball of the invention, the solid core may be formed of any desired material by any desired method. Any of well-known materials may be used for the core insofar as a golf ball with desirable properties is obtained.

More particularly, the solid core 1 of the solid golf ball according to the invention is formed from a conventional rubber composition by a conventional technique while properly adjusting vulcanizing conditions and formulation. Usually the core 1 is formed of a composition comprising a base rubber, a crosslinking agent, a co-crosslinking agent, and an inert filler. The base rubber may be selected from natural rubber and synthetic rubbers used in conventional solid golf balls. The preferred base rubber is 1,4-polybutadiene having at least 40% of cis-structure. The polybutadiene may be blended with natural rubber, polyisoprene rubber, styrene-butadiene rubber or the like. The crosslinking agent is typically selected from organic peroxides such as dicumyl peroxide and di-t-butyl peroxide, especially dicumyl peroxide. About 5 to 40 parts by weight of the crosslinking agent is generally blended with 100 parts by weight of the base rubber. The co-crosslinking agent is typically selected from metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. Examples of the inert filler include zinc oxide, barium sulfate, silica, calcium carbonate, and zinc carbonate, with zinc oxide and barium sulfate being often used. The amount of the filler blended is preferably 0 to about 30 parts by weight per 100 parts by weight of the base rubber although the amount largely varies with the specific gravity of the core and cover, the weight of the ball, and other factors. In the practice of the invention, the amount of the filler (typically zinc oxide and barium sulfate) is properly selected so as to provide the desired hardness to the core.

A core-forming composition is prepared by kneading the above-mentioned components in a conventional mixer such as a Banbury mixer and roll mill, and it is compression or injection molded in a core mold. The molding is then cured by heating at a sufficient temperature for the crosslinking agent and co-crosslinking agent to function (for example, a temperature of about 130° to 170° C. for a combination of dicumyl peroxide as the crosslinking agent and zinc acrylate as the co-crosslinking agent), obtaining a solid core.

The cover 2 enclosing the core is formed of a well-known composition, typically based on an ionomer resin. The ball parameters required by the invention are conveniently satisfied by a mixture of two or more ionomer resins. If desired, well-known additives such as titanium dioxide, barium sulfate, and magnesium stearate may be added to the ionomer resin for adjusting a specific gravity and hardness. UV absorbers, antioxidants and dispersing aids such as metal soaps may be added if desired. The cover composition may be molded over the solid core by any desired method, for example, by surrounding the core by a pair of preformed hemispherical cups followed by heat compression molding or by injection molding the cover composition over the core.

Like conventional golf balls, the golf ball of the invention is formed with a multiplicity of dimples in the cover surface. The ball is further subject to finishing steps including buffing, painting and stamping.

While the solid golf ball of the invention is constructed as mentioned above, it should have a diameter in accordance with the Rules of Golf, that is, a diameter of at least 41.15 mm for the small size and at least 42.67 mm for the large size.

The solid golf ball of the invention is best suited for golfers who swing at a low head speed. The term "low head speed" means a head speed of less than 40 m/sec. when a driver (#W1) is used as a club. Therefore, the solid golf ball of the invention is best suited for golfers with a low head speed of less than 40 m/sec.

According to the present invention, a solid golf ball characterized by a relatively light weight and an increased moment of inertia exhibits improved flight performance upon low head speed hitting, gives less shocks or a pleasant feel upon hitting, and ensures straight travel upon putting and approach strokes. The ball is best suited for those golf players with a low head speed.

EXAMPLE

Examples of the present invention are given below by way of illustration and not by way of limitation. All parts are by weight.

EXAMPLES 1–5 & COMPARATIVE EXAMPLES 1–2

A solid core was prepared by milling a solid core-forming rubber composition of the formulation shown in Table 1 in a roll mill and vulcanizing it in a mold at 155° C. for 20 minutes. A cover-forming composition of the formulation shown in Table 1 was then injection molded over the solid core, obtaining golf balls of Examples 1–4 and Comparative Examples 1–3.

With respect to the cover stock in Table 1, it is noted that Himilan is the trade name of an ionomer resin commercially available from Mitsui duPont Chemical K.K.

TABLE 1

| | Example | | | | Comparative Example | | |
|---|---|---|---|---|---|---|---|
| | 1 | 2 | 3 | 4 | 1 | 2 | 3 |
| Solid core (pbw) | | | | | | | |
| Cis-1,4—polybutadiene rubber | 100 | 100 | 100 | 100 | 100 | 100 | 100 |
| Zinc acrylate | 28 | 26 | 25 | 27 | 29 | 25 | 16 |
| Zinc oxide | 10 | 5 | 2 | 5 | 10 | 10 | 2 |
| Dicumyl peroxide | 0.9 | 0.9 | 0.9 | 0.9 | 0.9 | 0.9 | 0.9 |
| Barium sulfate | 1 | 2 | — | 1.5 | 10.5 | 12 | — |
| Antioxidant | 0.2 | 0.2 | 0.2 | 0.2 | 0.2 | 0.2 | 0.2 |
| Cover (pbw) | | | | | | | |
| Himilan 1706 | 50.0 | 50.0 | 50.0 | — | 50.0 | 50.0 | 50.0 |
| Himilan 1605 | 50.0 | 50.0 | 50.0 | — | 50.0 | 50.0 | 50.0 |
| Himilan 1601 | — | — | — | 50.0 | — | — | — |
| Himilan 1557 | — | — | — | 50.0 | — | — | — |
| Titanium dioxide | — | — | — | — | 5.0 | 5.0 | 5.0 |
| Magnesium stearate | 1.0 | 1.0 | 1.0 | 1.0 | 1.0 | 1.0 | 1.0 |
| Barium sulfate | 13.8 | 13.8 | 28.5 | 21.2 | — | — | — |

The golf balls were examined for feeling, flying performance, and straight travel on putting by the following tests.

Feeling Test

The ball was evaluated for hitting feel by hitting it with a driver (#W1). The rating was "Exc." for a very pleasant feel with very weak shocks, "Good" for a generally pleasant feel despite some shocks, and "Poor" for strong shocks.

Flying Test

Using a swing robot, the ball was hit by a driver (#W1) at a head speed (HS) of 35 m/sec. for determining a carry and total distance. The rating was "Good" or "Poor."

Straight Travel on Putt

A putter was mounted on a swing robot which was rested on a green presenting a slicing slope toward the target. The ball was hit five times at the same swing angle. The rolling distance from the stop position in the launch direction and the shift of the stop position from the launch direction were measured. The result is an average of five measurements. The rating was "Good" or "Poor."

The results are shown in Table 2.

TABLE 2

| | Example | | | | Comparative Example | | |
|---|---|---|---|---|---|---|---|
| | 1 | 2 | 3 | 4 | 1 | 2 | 3 |
| Core | | | | | | | |
| Weight (g) | 33.0 | 32.0 | 31.0 | 31.0 | 35.3 | 35.3 | 28.6 |
| Outer diameter (mm) | 38.5 | 38.5 | 38.5 | 38.1 | 38.5 | 38.5 | 38.1 |
| Specific gravity | 1.104 | 1.071 | 1.037 | 1.071 | 1.163 | 1.163 | 0.988 |
| Cover | | | | | | | |
| Specific gravity | 1.050 | 1.050 | 1.150 | 1.101 | 0.960 | 0.960 | 0.960 |
| Shore D hardness | 65 | 65 | 65 | 60 | 65 | 65 | 65 |
| Ball | | | | | | | |
| Weight (g) | 44.43 | 43.43 | 43.52 | 44.00 | 45.30 | 45.30 | 39.95 |
| Outer diameter (mm) | 42.70 | 42.70 | 42.70 | 42.70 | 42.70 | 42.70 | 42.70 |
| Moment of inertia ($g \cdot cm^2$) | 82.1 | 80.6 | 82.1 | 82.2 | 82.2 | 82.2 | 74.0 |
| PGA compression | 85 | 80 | 78 | 85 | 90 | 80 | 78 |
| Feel | Exc. | Exc. | Exc. | Exc. | Poor | Good | Exc. |
| HS35/#W1 | | | | | | | |
| Carry (m) | 151.0 | 150.0 | 151.5 | 150.5 | 146.2 | 148.0 | 150.0 |
| Total (m) | 162.0 | 163.0 | 162.5 | 162.5 | 155.5 | 158.0 | 160.5 |
| Rating | Good | Good | Good | Good | Poor | Poor | Good |
| Straight travel on putt | | | | | | | |
| Launch direction (m) | 10.8 | 10.7 | 10.7 | 10.8 | 11 | 11.5 | 10 |
| Lateral direction (m) | 0.7 | 0.8 | 0.7 | 0.7 | 0.5 | 0.7 | 1.5 |
| Rating | Good | Good | Good | Good | Good | Good | Poor |

As is evident from Table 2, the golf balls of Comparative Examples 1 and 2 having a greater weight do not fly a long distance. The ball of Comparative Example 3 having a light weight and a low moment of inertia does not travel straight on putting. In contrast, the golf balls of Examples 1 to 4 having an increased moment of inertia offer an increased flight distance despite a low head speed of 35 m/sec., straight travel upon putting and a pleasant hitting feel.

Although some preferred embodiments have been described, many modifications and variations may be made thereto in the light of the above teachings. It is therefore to be understood that within the scope of the appended claims, the invention may be practiced otherwise than as specifically described.

We claim:

1. A solid golf ball comprising, solid core and a cover, the ball having a weight of from 40 grams to less than 45 grams a moment of inertia of at least 80 $g \cdot cm^2$, and a PGA compression of up to 90.

2. The solid golf ball of claim 1 wherein the cover has a Shore D hardness of 50 to 70 degrees.

3. The solid golf ball of claim 1 wherein the cover has a specific gravity of at least 1.

4. The solid golf ball of claim 1 wherein the PGA compression is in the range of from 60 to 90.

5. The solid golf ball of claim 1 wherein said moment of inertia is in the range of 80 to 90 $g \cdot .cm^2$.

6. The solid golf ball of claim 1 wherein said solid core has a weight in the range of 24 to 37 grams.

7. The solid golf ball of claim 1 wherein said solid core has a diameter in the range of 38 to 40 mm.

8. The solid golf ball of claim 1 wherein said solid core has a specific gravity in the range of 0.85 to 1.15.

9. The solid golf ball of claim 1 wherein said cover has a hardness in the range of 50 to 70 on Shore D.

10. The solid golf ball of claim 1 wherein said cover has a specific gravity in the range of 1.0 to 1.3.

11. The solid golf ball of claim 1 wherein said cover has a radial thickness in the range of 1.4 to 2.4 mm.

* * * * *